US005380233A

United States Patent [19]

Numoto

[11] Patent Number: 5,380,233

[45] Date of Patent: Jan. 10, 1995

[54] ARTICULATED LIMB TOY FIGURE

[76] Inventor: Kiyomi Numoto, 47, 2-100 Makinohara, Matsudo, Japan

[21] Appl. No.: 76,836

[22] Filed: Jun. 15, 1993

[51] Int. Cl.[6] ..... A63H 33/04; A63H 33/26; A63H 3/46

[52] U.S. Cl. ..... 446/92; 446/99; 446/139; 446/378; 403/59; 403/DIG. 1

[58] Field of Search ..... 446/92, 97, 99, 101, 446/100, 129, 137, 138, 139, 373, 375, 376, 378, 37381, 383, 390; 403/59, DIG. 1

[56] References Cited

U.S. PATENT DOCUMENTS

| | | | |
|---|---|---|---|
| 2,059,338 | 11/1936 | Goodsill | 446/379 X |
| 3,009,284 | 11/1961 | Ryan | 446/376 |
| 3,699,715 | 10/1972 | Lewis et al. | 446/376 |
| 3,982,353 | 9/1976 | Christiansen | 446/97 |
| 4,038,775 | 8/1977 | Sato | 446/92 |
| 4,118,888 | 10/1978 | Ogawa | 446/92 |
| 4,651,458 | 3/1987 | Lanius | 446/99 X |
| 4,673,374 | 6/1987 | Kelly | 446/383 |
| 4,869,701 | 9/1989 | Kawaii et al. | 446/99 X |
| 4,952,189 | 8/1990 | Barlow | 446/383 X |

FOREIGN PATENT DOCUMENTS

| | | | |
|---|---|---|---|
| 927146 | 4/1947 | France | 446/92 |
| 999168 | 7/1965 | United Kingdom | 446/378 |
| 2191956 | 12/1987 | United Kingdom | 446/376 |

*Primary Examiner*—Robert A. Hafer
*Assistant Examiner*—D. Neal Muir
*Attorney, Agent, or Firm*—Howard C. Miskin

[57] ABSTRACT

A toy figure includes a hollow body having coupling openings formed in its upper side walls and bottom wall, the openings having inwardly tapered conical faces with peripherally spaced longitudinal channels. A magnet slab housed in the body is sandwiched by yoke plates which closely confront each opening. A coupling member having a circular base section with a ribbed conical face engages each opening and includes an inner portion of magnetic material engaged by the yoke plates to releasably retain the coupling members in the openings. An arm is attached to each coupling member for angular movement about an axis perpendicular to the axis of the coupling member base section.

7 Claims, 2 Drawing Sheets

ARTICULATED LIMB TOY FIGURE

BACKGROUND OF THE INVENTION

The present invention relates generally to improvements on articulated structures and it relates particularly to an improved angularly adjustable arm structure.

In articulated structures such as dolls, mannequins, toy robots, and the like it is desirable to permit the easy and convenient universal angular adjustment of arms forming parts of the structure. The arms may be any limb or appendage such as arms, legs, or any similar components. The adjustment should be universal and reliable, and the desired position should be secure and easily modified without the use of tools. To this end many angular adjustable joints have been available and proposed but leave much to be desired for the present purpose. They are often complex and expensive, difficult and inconvenient to manipulate, unreliable and awkward and possess many other drawbacks and disadvantages.

SUMMARY OF THE INVENTION

It is a principal object of the present invention to provide an improved articulated structure.

Another object of the present invention is to provide an improved angularly adjustable arm joint for limbs of dolls, mannequins, toy robots and the like.

Still another object of the present invention is to provide an improved angularly adjustable joint coupling a limb to a body of a doll, mannequin, toy device, or the like.

A further object of the present invention is to provide an improved angularly adjustable coupling joint which is easily and conveniently operated and is releasably fixed in selected preset positions.

Still a further object of the present inventions to provide an improved articulated structure of the above nature which is rugged, inexpensive, highly reliable and of great versatility and adaptability.

The above and other objects of the present invention will become apparent from a reading of the following description taken in conjunction with the accompanying drawings which illustrate preferred embodiments thereof.

A structure in accordance with the present invention includes a body member having a socket or opening formed therein and a permanent magnet device located in the body member proximate the opening or socket to establish a magnetic field in the opening or socket, a plug member engaging the opening or socket and having a magnetic piece confronting the magnet to releasably retain the plug in the opening or socket and an arm coupled to the plug externally of the body member.

In the preferred form of the subject improved structure the plug and opening have confronting circular faces with regularly spaced separably axially relatively movable mating recesses and projections inhibiting the relative rotation of the plug and opening. The permanent magnet device includes a permanent magnet sandwiched between the opposite arms of a magnetic yoke terminating in opposite end poles confronting and proximate the opening. A limb simulating arm is adjustably angularly coupled to the plug. The improved structure is simple, inexpensive and rugged, easy and convenient to operate, highly reliable and of great versatility and adaptability.

DESCRIPTION OF THE PREFERRED EMBODIMENT

Figure 1:
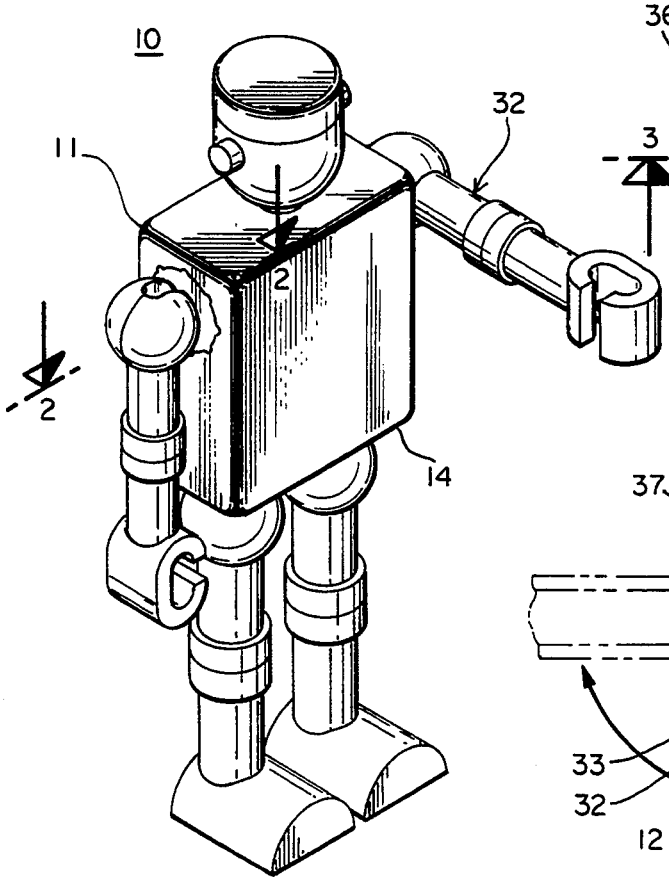
FIG. 1 is a front perspective view of a toy robot embodying the present invention.
Figure 2:
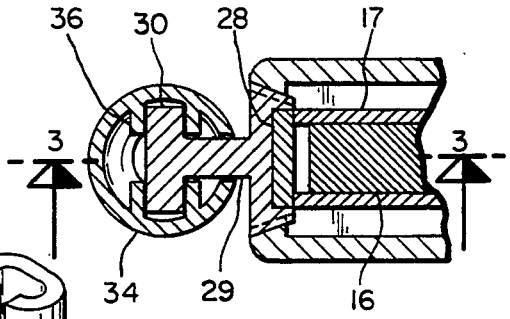
FIG. 2 is an enlarged sectional view taken along line 2—2 in FIG. 1.
Figure 3:
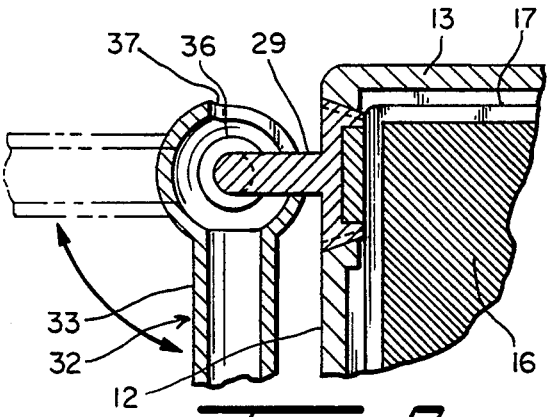
FIG. 3 is a sectional view taken along line 3—3 in FIG. 2.
Figure 4:
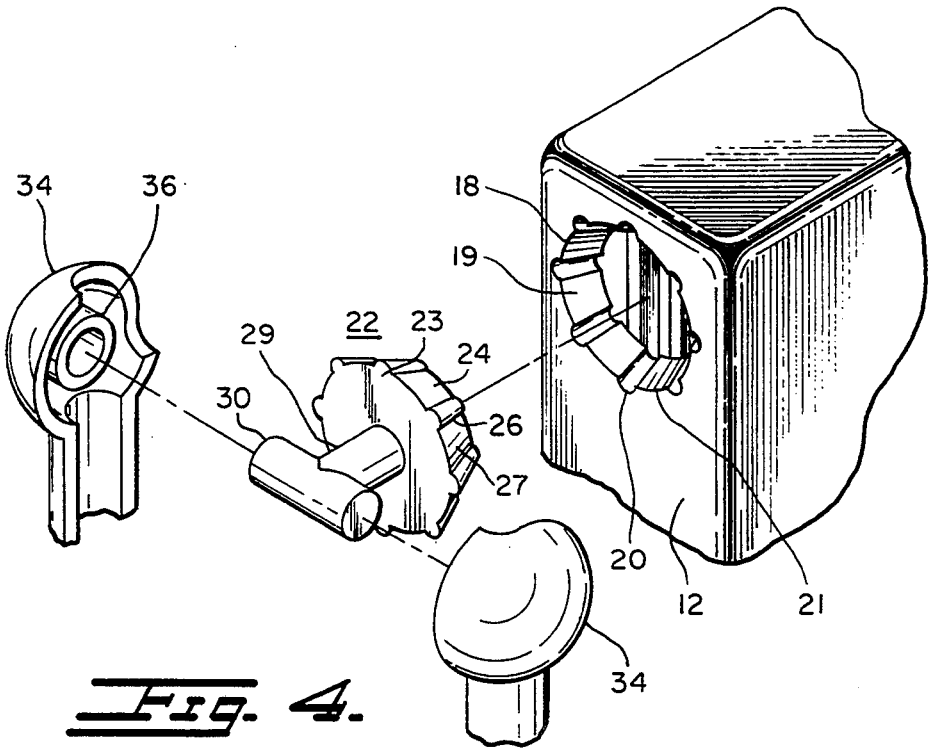
FIG. 4 is an enlarged fragmented exploded view of the shoulder joint of the robot.

Referring to the drawings, particularly FIGS. 1 to 4 thereof, which illustrate a preferred embodiment of the present invention, the reference numeral 10 generally designates a device employing the improved structure and shown, by way of example, as a toy robot, it being understood that it may be otherwise shaped and dimensioned. The device 10 includes a thin hollow body member 11, having vertical opposite parallel side walls 12 and horizontal parallel top and bottom rectangular walls 13 and 14 respectively.

Housed in body member 11 and proximately spaced from the top, bottom, and side walls thereof is a rectangular permanent magnet 16 located medially between the body member front and rear walls. A pair of rectangular plates 17 of magnetic material sandwiched magnet 16, overlaying its front and rear faces, the borders of plates 17 projecting beyond the corresponding edges of magnet 16 into close proximity to the body member top, bottom, and side walls and defining respective pair of opposite magnetic poles.

A circular opening 18 is medially formed in each side wall 12 directly below top wall 13 and a pair of similar openings is formed in bottom wall 14 proximate side walls 12. Each opening 18 has an inwardly tapered conical face 19 having formed therein regularly peripherally spaced longitudinally extending channels 20 of arcuate transverse cross section separated by longitudinal extending ridges 21.

A limb coupling member 22 separably engages each opening 18 at a respective preselected angle about the axis of the opening. Specifically, each coupling member 22 includes a circular base 23 somewhat longer than the depth of opening 18 and having a conical peripheral face 24 complementing opening peripheral face 19 including longitudinal ridges 26 spaced by longitudinal channels 27. Base 23 slidably nests in opening 18 with ridges 26 longitudinally slidably engaging valleys or channels 20, the base inner end projecting inwardly of the inner end of opening 18. A circular well is formed in the inside face of each base 23 and a disc 28 of ferromagnetic material nests in each of the wells and is suitably secured therein. Integrally formed with each base 23 and extending axially outwardly therefrom is a short cylindrical post 29 terminating at its outer end in a diametrically extending axle or pin 30.

A limb member 32 is swingably supported by each coupling member 22 and includes a tubular arm 33 terminating at its outer end in a hand, claw or the like and at its inner end in a hollow spherical housing 34, member 32 being formed of a pair of longitudinally extending similarly shaped sections suitably mutually joined Integrally formed with the opposing sections of housing 34 are a pair of opposing coaxial cylindrical bearing sockets 36 which snugly angularly adjustably engage respective opposite ends of axle 30. An arcuate slot 37 formed in the outer end section of housing 34 slidably engages post 29 to permit the swinging of arm 32 about axle 30.

In the assembled condition of device 10 coupling member base 24 snugly nest in respective openings 19 at preselected angles with ridges 26 engaging opening channels 20. Bases 24 are separably firmly retained in respective openings 19 under the attracting magnetic influence of yoke sandwiched magnet 16 on magnetic discs 28. The angle of each axle 30 may be adjusted by retracting the respective coupling member base 24 from related opening 19, rotating the coupling member to the desired angle and reinserting it into opening 19. Moreover each limb 32 may be angularly adjusted or swung about its support axle 30.

Figure 5:
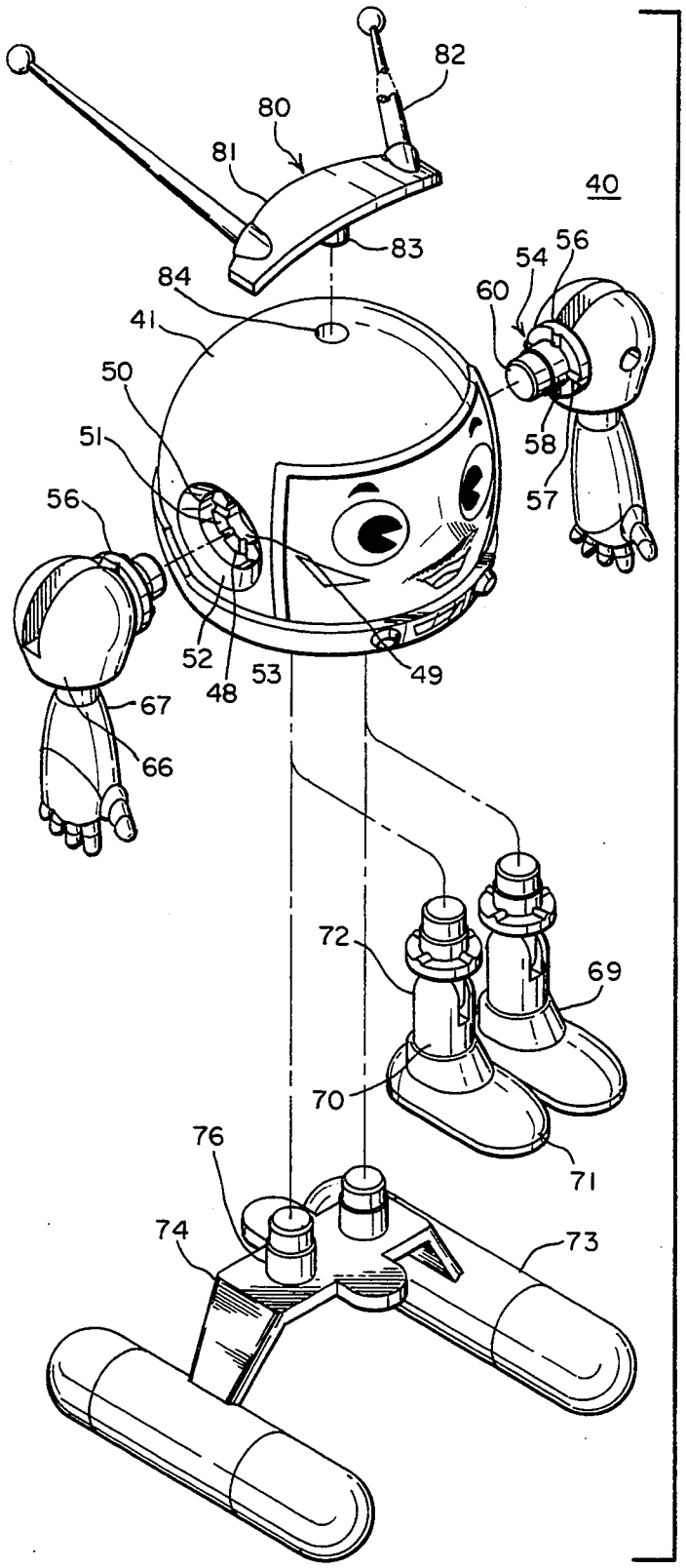
FIG. 5 is an exploded perspective view of another embodiment of the present invention.
Figure 6:
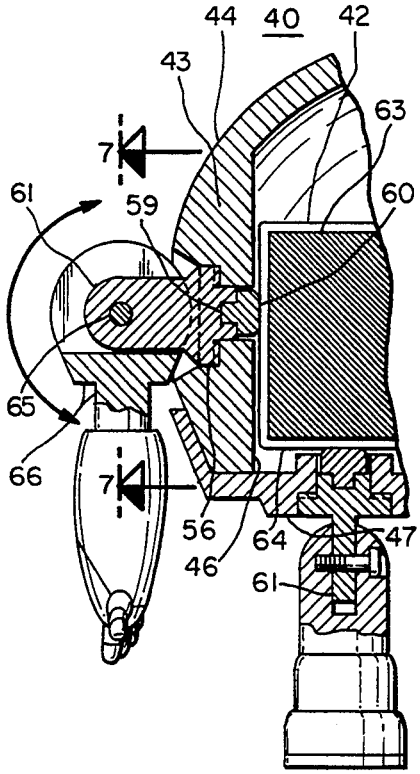
FIG. 6 is a front fragmented elevational view thereof.
Figure 7:
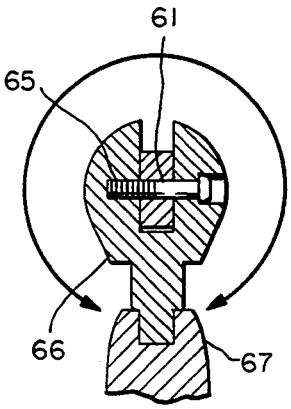
FIG. 7 is a sectional view taken along line 7—7 in FIG. 6.

Referring now to FIGS. 5 to 7 of the drawing which illustrate another embodiment of the present invention, the reference numeral 40 designates the modified toy structure which includes a spherically shaped hollow body member 41 housing a permanent magnet member 42. Body member 41 includes opposite vertical side walls 43 having arcuate outside faces 44 and flat vertical inside faces 46 and a flat horizontal bottom wall 47 suitably secured to the bottoms of walls 43.

Formed in each of side walls 43 are centrally located coupling openings 48, each of which includes an inner small diameter axial bore 49 having a cylindrical face, an intermediate larger diameter bore 50 coaxial with and delineated from bore 49 by a flat annular shoulder 51 and a tapered conical outer bore 52. Formed in annular shoulder 51 are a plurality of regularly spaced radially extending arcuate groves or channels 53.

Separably engaging each coupling opening 48 is a coupling member 54 including a circular base section 56 separably nesting in intermediate bore 50 and resting on shoulder 51. Base section 56 has regularly spaced radial ribs or ridges 57 formed in its inside end face and separably nesting in groves 53 in the coupling member coupling opening engaged position. Projecting coaxially inwardly from each base member 56 is a cylindrical projection 58 slidably engaging bore 49 and having a stepped axial well formed therein firmly and engaged by the shank 59 and enlarged, rounded, flat head 60 of a button formed of a magnetic material. A flat bracket member 61 projects medially axially outwardly from and is integrally formed with base section 56.

Magnet member 42 includes a permanent magnet slob 63 sandwiched between rectangular yoke plates 64 of magnetic material projecting beyond magnet slab 63. The end faces of plates 64 proximate respective coupling openings define magnetic poles which magnetically attract button heads 60 and strongly releasably retain the coupling members 48 in their coupling opening engaged positions, the respective coupling members being prevented from rotation from their preselected angular adjustment by the engagement between mutually registering groves 53 and ridges 57.

Journalled to each of the brackets 61 of the side wall mounted coupling members 54 by means of a pivot pin 65 is a bifurcated knuckle 66 swingably embracing a respective bracket 61. An arm 67 extends from knuckle 66 and terminates in a hand section 68. Leg members 69 include arms 70 formed at their bottoms with foot members 71 and terminate at their tops in bifurcated knuckle sections 72 pivot pin connected and embracing respective brackets 61 of the bottom coupled coupling members 54 in the manner of arms 67.

Alternatively, the legs 69 may be replaced by another device, for example a pair of longitudinally extending parallel pontoons joined by a raised bridge member 74 having mounted thereon a pair of coupling pins 76 laterally spaced the distance between the bottom wall coupling openings. Each coupling pin 76 is similar in structure to coupling member 54 without the base section 54 and bracket 6! and may be separably coupled to the bottom wall coupling openings.

An antenna member 80 is detachably centrally mounted atop body member 41 and includes a curved cross piece 81 complementing the top face of body member 41 and a pair of elongated antenna members 82 upwardly rearwardly inclined from opposite ends of cross piece 81 and separably engages a coupling opening 84 formed in the top of the body member.

While there have been described and illustrated preferred embodiments of the present invention, numerous alterations, omissions, and additions may be made without departing from the spirit thereof. For example, the shapes and functions of the various limbs and other members as well as the shape of the body member and other members may be modified to achieve different end products. Thus, if the members are so designed and shaped, a refrigerator or other product may be modified to an airplane or another appliance by removing some elements and replacing them with different shaped elements.

I claim:

1. An adjustable arm-structure comprising a body member with a wall having formed therein a coupling socket having front and rear openings and being coaxial with a first axis, a magnetic member housed in said body member proximate said socket front opening, a coupling plug coaxially slidably engagable with said socket and movable between an advanced forward position in said socket and a retracted position, said coupling plug and socket having confronting faces separably engagable in said coupling plug advanced position to releasably lock said plug and socket against mutual angular movement about said first axis said confronting faces comprising cooperating ridge means and a plurality of channel means, wherein said ridge means selectively engages at least one channel means, said coupling plug including a front ferromagnetic section attracted by said magnet member to urge and releasably maintain said coupling plug in said advanced position, an arm member and means connecting said arm member to said coupling plug for swinging only about a second axis transverse to said first axis and angularly adjustable with said plug about said first axis.

2. The structure of claim 1 wherein said coupling socket and plug are circular and the respective confronting faces thereof respectively have regularly spaced ridges and channels which are separably engaged when said plug is in said advanced position.

3. The structure of claim 1 where said magnet member includes a pair of spaced ferromagnetic plates and a permanent magnet sandwiched between said plates, said plates terminating in end faces defining magnetic poles proximate said socket front opening.

4. The structure of claim 1 wherein said plug has an inwardly directed face with a well formed therein and said ferromagnetic section includes a ferromagnetic member nesting in said well.

5. The structure of claim 2 wherein said plug and socket confronting faces are conical and said ridges and channels are mutually engaged and relatively slidable.

6. The structure of claim 1 wherein said rocket includes a stepped longitudinal bore including an inner section and an outer section of greater diameter than said inner section and delineated therefrom by an outwardly facing first annular shoulder, said coupling plug including a stepped pin having inner and outer sections delineated by a second annular shoulder confronting said first shoulder, said first and second shoulders respectively having mutually separably engaging ridges and groves formed therein.

7. The structure of claim 1 wherein said coupling plug includes a rearwardly projecting axial post terminating in a transversely extending axle, and comprising a pair of opposing coaxial socket members located at an end of said arm and rotatably engaging respective ends of said axle.

* * * * *